US010066502B2

(12) United States Patent
Anderson

(10) Patent No.: US 10,066,502 B2
(45) Date of Patent: Sep. 4, 2018

(54) BLADED ROTOR DISK INCLUDING ANTI-VIBRATORY FEATURE

(71) Applicant: United Technologies Corporation, Hartford, CT (US)

(72) Inventor: Carney R. Anderson, East Haddam, CT (US)

(73) Assignee: United Technologies Corporation, Farmington, CT (US)

( * ) Notice: Subject to any disclaimer, the term of this patent is extended or adjusted under 35 U.S.C. 154(b) by 287 days.

(21) Appl. No.: 14/918,923

(22) Filed: Oct. 21, 2015

(65) Prior Publication Data

US 2016/0115821 A1 Apr. 28, 2016

Related U.S. Application Data

(60) Provisional application No. 62/067,118, filed on Oct. 22, 2014.

(51) Int. Cl.

| | |
|---|---|
| ***F01D 25/06*** | (2006.01) |
| ***F01D 5/30*** | (2006.01) |
| ***F01D 5/02*** | (2006.01) |
| ***F01D 5/10*** | (2006.01) |

(52) U.S. Cl.

CPC ..... *F01D 25/06* (2013.01); *F01D 5/02* (2013.01); *F01D 5/3007* (2013.01); *F01D 5/10* (2013.01); *F05D 2260/96* (2013.01)

(58) Field of Classification Search

CPC ... F01D 5/027; F01D 5/04; F01D 5/06; F01D 5/10; F01D 5/147; F01D 5/3007; F04D 29/668; F05D 2260/96

See application file for complete search history.

(56) References Cited

U.S. PATENT DOCUMENTS

| | | | | |
|---|---|---|---|---|
| 5,688,108 | A * | 11/1997 | Dierksmeier | F01D 5/081 415/200 |
| 5,871,314 | A * | 2/1999 | Trionfetti | G01M 1/34 409/162 |
| 6,682,307 | B1 * | 1/2004 | Tiemann | F01D 11/006 416/193 A |
| 7,104,760 | B2 | 9/2006 | Burdgick | |
| 7,118,331 | B2 | 10/2006 | Shahpar | |
| 7,600,979 | B2 | 10/2009 | Steibel et al. | |
| 7,828,526 | B2 | 11/2010 | Cairo et al. | |
| 8,241,003 | B2 | 8/2012 | Roberge | |
| 8,342,804 | B2 * | 1/2013 | Pronovost | F01D 5/027 416/144 |

(Continued)

OTHER PUBLICATIONS

Extended European Search Report for Application No. 15190105.2 dated Mar. 22, 2016.

*Primary Examiner* — Logan Kraft
*Assistant Examiner* — Elton Wong
(74) *Attorney, Agent, or Firm* — Carlson, Gaskey & Olds, P.C.

(57) ABSTRACT

A rotor disk includes a ring shaped rotor body defining a radially inward opening, rims protrude radially outward from the rotor body, and outwardly facing rotor blade retention slots are defined between circumferentially adjacent rims. Each slot is operable to receive and retain a corresponding rotor blade, and each rim of the rims includes an anti-vibratory feature. The anti-vibratory feature includes a structure defining an isogrid pattern intruding into a surface of the rim.

10 Claims, 7 Drawing Sheets

(56) References Cited

U.S. PATENT DOCUMENTS

| | | | | |
|---|---|---|---|---|
| 8,375,699 | B1 | 2/2013 | Atassi et al. | |
| 8,739,515 | B2 | 6/2014 | Schwark, Jr. et al. | |
| 8,967,961 | B2 | 3/2015 | McCaffrey | |
| 2004/0151585 | A1 | 8/2004 | Jones | |
| 2009/0325468 | A1 | 12/2009 | El-Wardany et al. | |
| 2013/0209260 | A1* | 8/2013 | Stone | F01D 5/027 416/205 |
| 2014/0023504 | A1* | 1/2014 | Fernandez | F01D 5/027 416/144 |
| 2015/0292337 | A1* | 10/2015 | Gentile | F01D 5/26 416/223 R |

* cited by examiner

BLADED ROTOR DISK INCLUDING ANTI-VIBRATORY FEATURE

CROSS-REFERENCE TO RELATED APPLICATION

This application claims priority to U.S. Provisional Application No. 62/067,118 filed Oct. 22, 2014.

TECHNICAL FIELD

The present disclosure relates generally to bladed rotor disk assemblies for a gas powered turbine, and more specifically to an anti-vibratory feature for the same.

BACKGROUND

Gas powered turbines, such as those used in commercial and military aircraft, include a compressor that compresses air, a combustor that mixes the compressed air with a fuel and ignites the mixture, and a turbine section through which the resultant combustion gasses are expanded. The expansion of the combustion gasses across the turbine section drives the turbine section to rotate. The turbine section is connected to the combustor section via one or more shafts, and the rotation of the turbine section drives the compressor section to rotate.

Multiple compressor and turbine stages are included in each of the corresponding sections, with each stage including a rotor and a corresponding stator or a corresponding vane. Rotor based systems, such as a gas turbine engine, often display coupled vibratory modes during engine operation. A coupled vibratory modes place high vibratory stresses on the rotor disk, the rotor blade, or both the rotor disk and the rotor blade when the engine is operating at or near a certain frequency.

Further, any given rotor blade or rotor disk can include multiple distinct vibratory modes, with each distinct vibratory mode corresponding to a particular engine rotational speed. In an ideal engine, every vibratory mode of a given rotor assembly is tuned to fall significantly higher than the frequency range of the typical engine operation. However, tuning rotor disks and rotor blades such that the vibratory modes fall significantly higher than the frequency range of typical engine operation significantly increases the weight of the corresponding rotor, and is not practical in all cases due to engine component size constraints.

SUMMARY OF THE INVENTION

In one exemplary embodiment, a rotor disk includes a ring shaped rotor body defining a radially inward opening, rims protruding radially outward from the rotor body, and outwardly facing rotor blade retention slots defined between circumferentially adjacent rims. Each slot is operable to receive and retain a corresponding rotor blade, and each rim of the rims includes an anti-vibratory feature. The anti-vibratory feature includes a structure defining an isogrid pattern intruding into a surface of the rim.

In another exemplary embodiment of the above described rotor disk, the isogrid pattern comprises a plurality of geometric intrusions into the surface, and wherein the geometric intrusions are separated by, and define, a plurality of stiffening ribs.

In another exemplary embodiment of any of the above described rotor disks, each of the geometric intrusions is a uniform shape.

In another exemplary embodiment of any of the above described rotor disks, the geometric intrusions vary in at least one of a depth, a corner angle, a cross sectional area.

In another exemplary embodiment of any of the above described rotor disks, the geometric intrusions include at least two distinct geometric shapes.

In another exemplary embodiment of any of the above described rotor disks, each of the geometric intrusions intrudes a uniform radial depth into the surface.

In another exemplary embodiment of any of the above described rotor disks, the anti-vibratory feature includes localized tuning features local to subsections of the surface.

In another exemplary embodiment of any of the above described rotor disks, the plurality of geometric intrusions comprises at least one of triangular intrusions, rectangular intrusions, and circular intrusions.

In another exemplary embodiment of any of the above described rotor disks, the surface is a radially outward facing surface of the rim.

In another exemplary embodiment of any of the above described rotor disks, the surface extends a full axial length of the rim.

An exemplary method for reducing vibrational bending in a bladed rotor disk includes tuning a rotor rim for at least one vibrational mode using an anti-vibratory feature. The anti-vibratory feature comprises an isogrid pattern.

In a further example of the above exemplary method, the anti-vibratory feature is disposed on a radially outward facing surface of a rotor rim.

In a further example of any of the above exemplary methods tuning a rotor rim for at least one vibrational mode comprises providing localized vibrational tuning in distinct subsections of the rotor rim.

In a further example of any of the above exemplary methods the localized vibration tuning is achieved utilizing an isogrid pattern having geometric intrusions where at least one of a radial depth of the geometric intrusion, a cross sectional area of the geometric intrusion, and a corner angle of the geometric intrusion is varied across the isogrid pattern.

In one exemplary embodiment, a rotor disk for utilization in a gas turbine engine includes a ring shaped rotor body defining an axis, rim features protruding radially outward from the ring shaped body, and outwardly facing rotor blade retention slots defined between circumferentially adjacent rims. Each rim of the rims includes an anti-vibratory feature. The anti-vibratory feature includes a structure defining an isogrid pattern intrudes into a surface of the rim.

In another exemplary embodiment of the above described rotor disk, the isogrid pattern comprises a plurality of geometric shaped intrusions into the radially outward facing surface, and a plurality of ribs defined by the geometric intrusions.

In another exemplary embodiment of any of the above described rotor disks, the geometric intrusions are a uniform geometric shape.

In another exemplary embodiment of any of the above described rotor disks, the geometric intrusions are a plurality of varied geometric shapes.

In another exemplary embodiment of any of the above described rotor disks, at least one of a radial depth of the geometric intrusion, a cross sectional area of the geometric intrusion, and a corner angle of the geometric intrusion is varied across the radially outward facing surface such that the anti-vibratory feature includes localized tuning for a plurality of vibratory modes.

In another exemplary embodiment of any of the above described rotor disks, the isogrid pattern is cast with the rim.

These and other features of the present invention can be best understood from the following specification and drawings, the following of which is a brief description.

DETAILED DESCRIPTION OF AN EMBODIMENT

Figure 1:
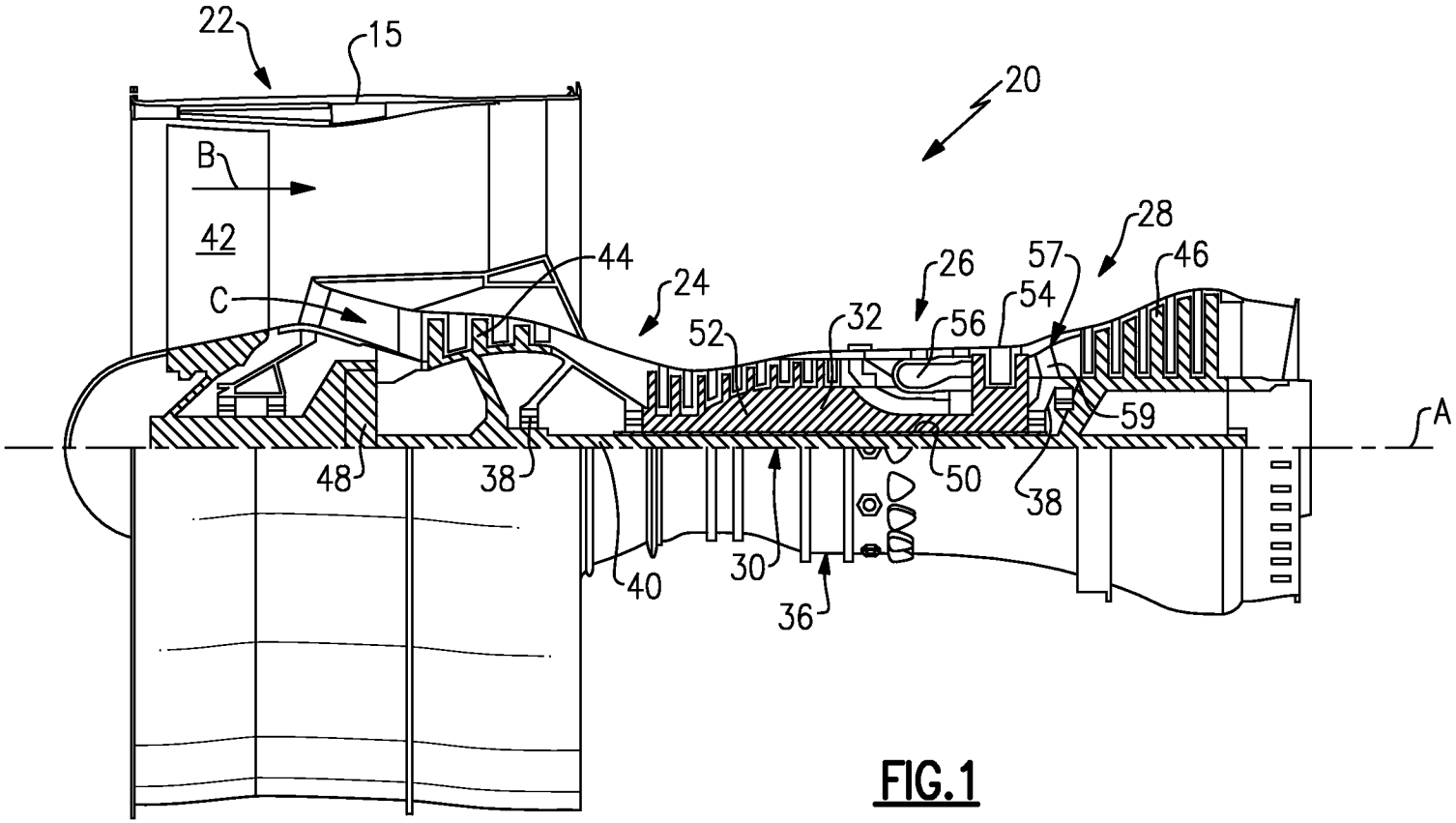
FIG. 1 schematically illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFCT')"—is the industry standard parameter of 1 bm of fuel being burned divided by 1 bf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]0.5. The "Low corrected fan tip speed" as disclosed herein according to one non-limiting embodiment is less than about 1150 ft/second.

Each stage within the compressor section 24 and the turbine section 28 is defined by a rotor and a corresponding stator or a corresponding vane. Each rotor includes a rotor disk section with multiple rotor blades protruding radially outward from the rotor disk section. This arrangement is also referred to as a bladed rotor disk. Due to the specific sizes and shapes of the rotor blades and the rotor disks, bladed rotor disks are subject to unwanted vibratory modes while the engine is operating at certain frequencies. Unwanted vibratory modes are instances of the rotor blade, the rotor disk, or both exhibiting undesirable vibrations while rotating at or near a specific frequency.

The vibrations caused by the vibratory modes can be bending vibrations, torsional vibrations, or both. A bending vibration occurs when a rotor blade root and a rotor disk rim vibrate causing the blade to bend. A torsional vibration occurs when vibration of the rotor blade and a rotor disk rim causes the blade to twist about the spanwise direction. Depending on the coupled vibratory mode, the disk lug will deflect differently. For one case the disc lug may tend to twist from front to back at max blade deflection, while in another the disc lug may simply bend uniformly from front to back.

By way of example, if the foremost portion of the rotor rim is bending clockwise, and the aftmost portion of the rim is bending counterclockwise, the bending is a torsional bending. In further examples, the torsional or bending vibrations can be localized to a specific portion of the rotor rim. In yet further examples, the torsional or bending vibrations can be spread across the rotor rim, but have a particularly strong effect in a localized portion of the rotor rim.

Figure 2A:
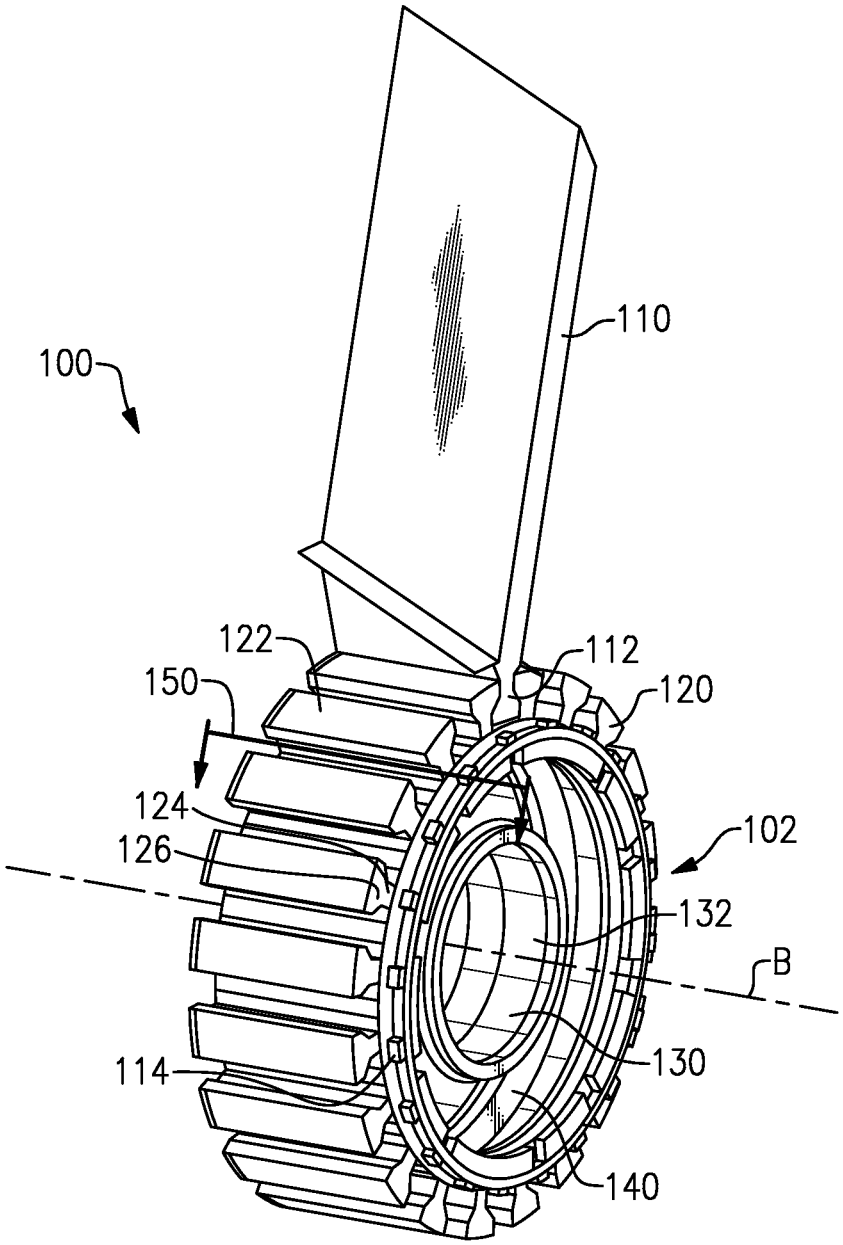
FIG. 2A schematically illustrates an isometric view of a typical rotor assembly.

With continued reference to FIG. 1, FIG. 2A schematically illustrates an isometric view of a bladed rotor assembly 100 including a rotor disk 102 and a single exemplary rotor blade 110 interconnected with the rotor disk 102. In an installed configuration, multiple rotor blades 110 are connected to the rotor disk 102, however only a single rotor blade 110 is illustrated for explanatory purposes.

The rotor disk 102 has a generally ring shaped rotor body 140 that defines an axis B. Multiple rotor rims 120 protrude radially outward from the ring shaped rotor body 140. The rotor rims 120 are alternatively referred to as dead rims. Each rotor rim 120 has a stem portion 124 and a body portion 126, with the stem portion 124 connecting the body portion 126 to the ring shaped rotor body 140. Each rotor rim 120 further includes a radially outward facing surface 122 that extends the axial length of the rotor disk 102.

Defined between each rotor rim 120 and each adjacent rotor rim 120 is a slot 114. In an assembled configuration, a root portion 112 of a rotor blade 110 is received and retained in the slot 114. The root portion 112 can be retained using any known rotor blade retention configuration including a fir tree connection or any similar root portion 112 and rotor disk 102 interfacing.

A radially inward facing surface 130 of the bladed rotor disk 100 includes an interfacing feature 132 for interfacing the rotor disk 102 with a corresponding shaft. In one example, the interfacing feature 132 can be a spline. In alternative examples, any suitable interfacing feature can be used in place of a spline.

Figure 2B:
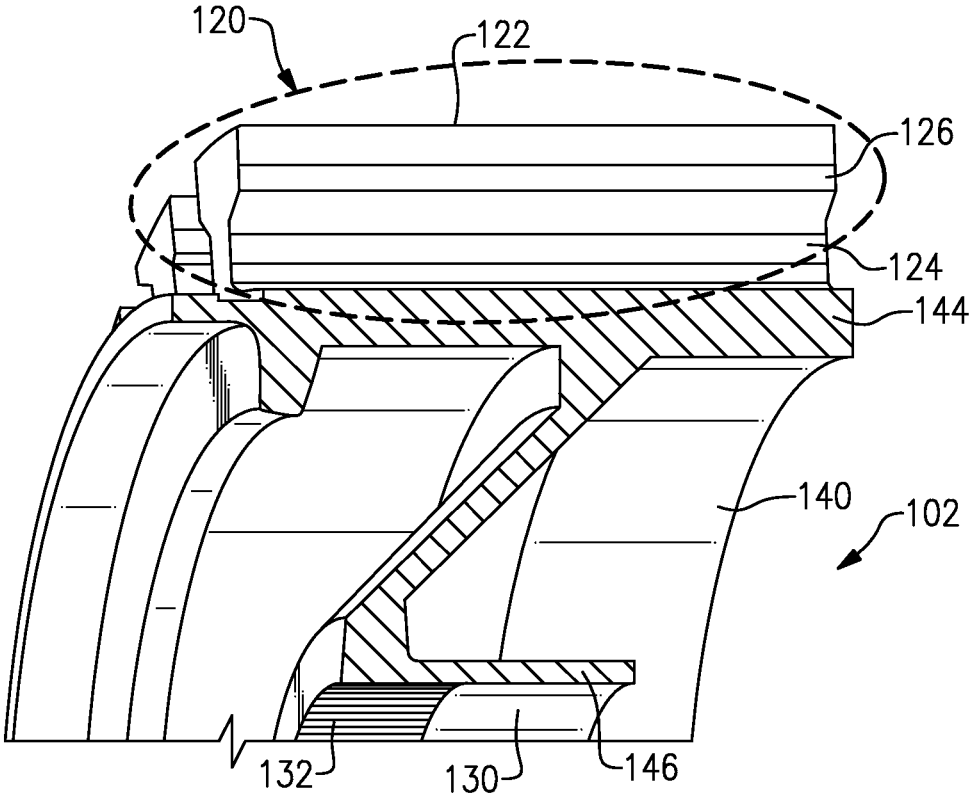
FIG. 2B schematically illustrates a partial cross sectional view of the rotor assembly of FIG. 2A.

With continued reference to FIGS. 1 and 2A, FIG. 2B illustrates a cross sectional view of the rotor disk 102 of FIG. 2A cut along view line 150. The ring shaped rotor body 140 includes a ring shaped plate element 142 connecting a radially outward body segment 144 to a radially inward body segment 146. The interfacing feature 132 and the radially inward facing surface 130 of the rotor body are included on the radially inward body segment 146. Similarly, each of the rotor rims 120 protrudes radially outward from the radially outward body segment 144.

During operation of the gas turbine engine 20 (illustrated in FIG. 1), certain engine rotational speeds can cause the bladed rotor assembly 100 to vibrate in either a torsional vibration or a bending vibration. Existing design paradigms attempt to address the vibrational bending by adding material to the rotor rim 120. Adding material to the rotor rim 120 increases the engine rotational speeds that cause the vibrational bending, but also carries an associated increase in weight of the bladed rotor disk assembly. The adjustment to the rotational speeds that causes the vibrational bending is referred to as vibrational tuning. Further, bladed rotor disks frequently have multiple vibratory modes (multiple engine operation frequencies that cause vibrations), and tuning the rotor rim to move one vibratory mode outside of the expected engine rotational speeds can unintentionally shift another vibratory mode into the expected engine rotational speeds.

With continued reference to FIGS. 1, 2A and 2B, FIG. 3A illustrates an example rotor disk 200 including an anti-vibratory feature 260 in a rotor rim 220. The general rotor disk 200 structure is the same as the bladed rotor disk 100 illustrated in FIGS. 2A and 2B, with a ring shaped rotor disk body 240, and multiple rotor rims 220 protruding radially outward from the rotor disk 200. Each of the rotor rims 220 includes a stem 224 and a rim body portion 226 having a radially outward facing surface 222.

Incorporated into each of the body portions 226 of the rims 220 is an anti-vibratory feature 260 including an isogrid pattern protruding radially into the outward facing surface 220. The isogrid pattern is, in some examples, machined into the radially outward facing surface 222. One of skill in the art having the benefit of this disclosure will understand that, in general, an isogrid pattern is a partially hollowed out structure including integral stiffening ribs. In some examples, the isogrid structure utilizes a triangular stiffening rib structure. In other examples, alternative shaped stiffening ribs can be utilized to similar effect.

Figure 3A:
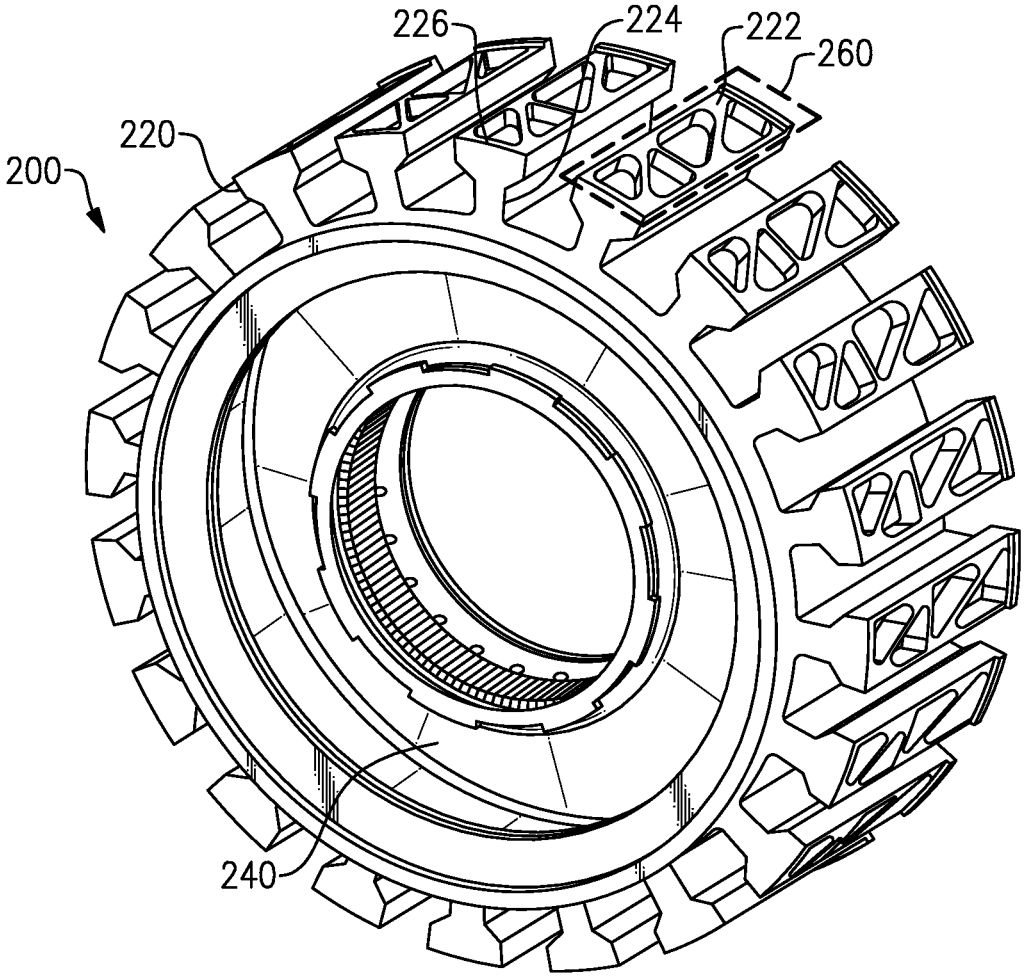
FIG. 3A schematically illustrates an isometric view of a rotor disk assembly including an anti-vibratory feature.
Figure 3B:
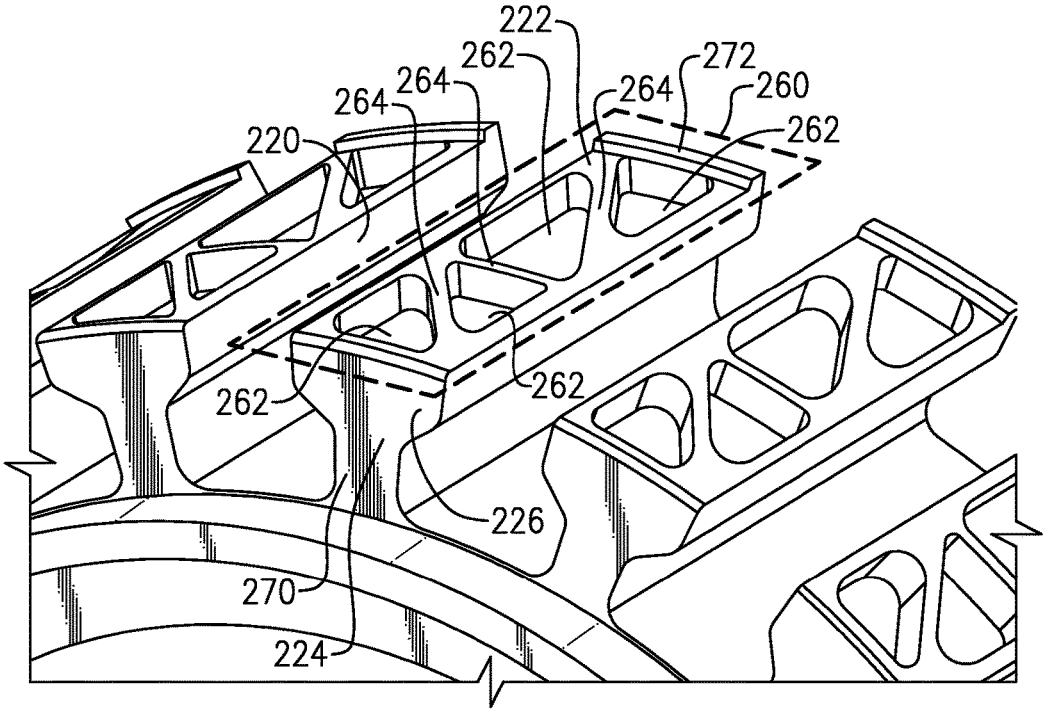
FIG. 3B schematically illustrates a zoomed in partial view of the rotor assembly of FIG. 2A.
Figure 4:
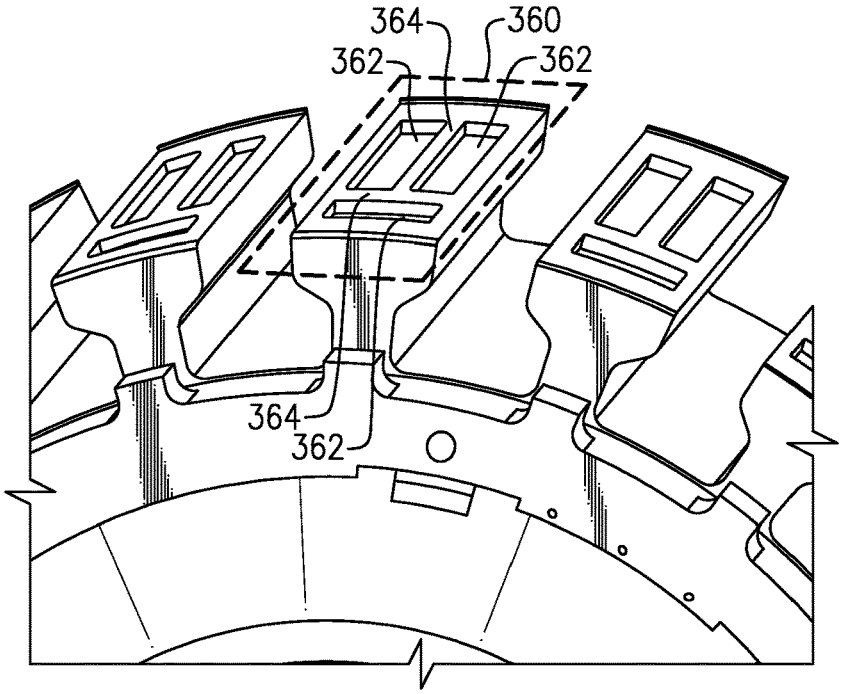
FIG. 4 illustrates a first alternate isogrid pattern anti-vibratory feature for a rotor assembly.
Figure 5:
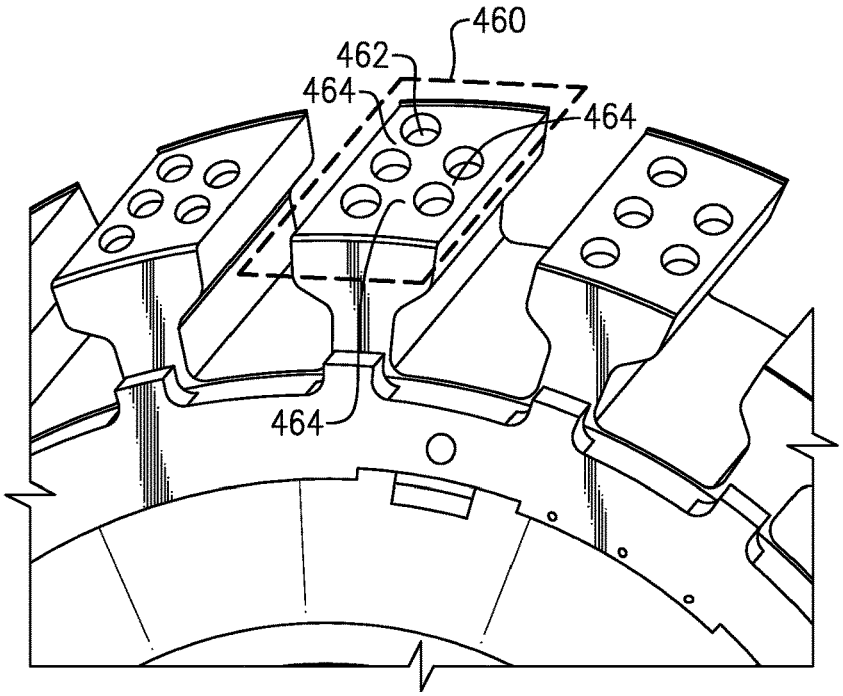
FIG. 5 illustrates a second alternate isogrid pattern anti-vibratory feature for a rotor assembly.
Figure 6:
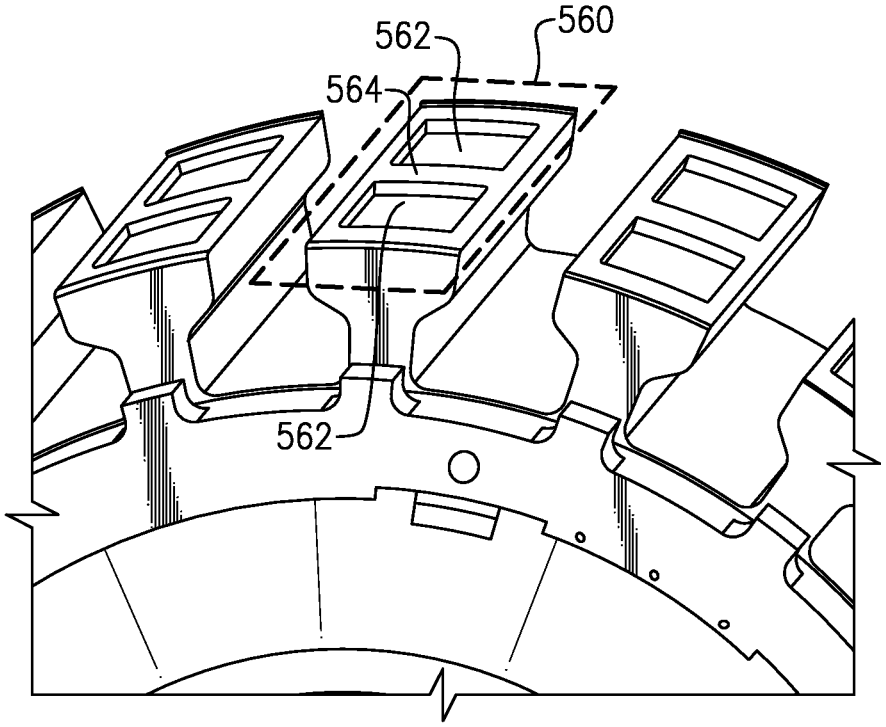
FIG. 6 illustrates a third alternate isogrid pattern anti-vibratory feature for a rotor assembly.

With continued reference to FIGS. 1, 2A, 2B and 3A, FIG. 3B schematically illustrates a zoomed in view of the rotor rims 220 of FIG. 3B, illustrating the anti-vibratory feature 260. The anti-vibratory feature 260 is an isogrid pattern that is machined into the exterior facing surface 222 of the rotor rim 220. Isogrid patterns as anti-vibratory features 260 are generally created using a set of geometric shapes intruding into the rotor rim to create the stiffening ribs, while adding a minimal amount of weight to the rotor rim. While the example illustrated in FIGS. 3A and 3B utilizes triangular geometric shapes, alternative shaped intrusions can be utilized to provide the same, or a similar, effect. The illustrated isogrid pattern utilizes varied sized and dimensioned triangular intrusions 262 machined into the exterior facing surface 222 to create stiffening ribs 264 that circumferentially span the radially outward facing surface 222 of the rim 220.

With regards to the shapes and depths of the triangular intrusions 262, one of skill in the art, having the benefit of this disclosure, will understand that the specific radial depth of the triangular intrusions 26 and size of the triangular intrusions 26 can be adjusted to compensate for expected bending due to vibration. In this way, the rotor rims 220 can be tuned for specific vibratory modes while minimally affecting other vibratory modes, thereby decreasing the risk of exciting a damaging mode during operation. By way of example, the triangular intrusions 26 at an upstream edge 270 of the rotor rim 220 have a smaller cross-sectional area and are tuned to a type of vibration that is localized at the upstream edge 270. Similarly, the triangular intrusions 26 at a downstream edge of the rotor rim 220 have a larger cross-sectional area, and are tuned to vibrations that are localized at the downstream edge 272. In alternative examples, the radial depth of the triangular intrusions 262 can be varied further to provide further tuning.

The particular cross sectional area, corner angles, and radial depth of the isogrid pattern for a given rotor rim 220 can be determined by one of skill in the art based on the parameters and needs of a given engine. In this way, the isogrid pattern can be specifically designed to tune multiple vibratory modes, and to tune specific locations for vibratory modes that have an increased localized effect.

With specific regard to the anti-vibratory feature 260 illustrated in FIG. 3A, the smaller triangular intrusions 262 located at the upstream edge 270 stiffen the rotor rim 220 against a first vibratory mode, while the larger triangular intrusions 262 located near the downstream edge 272 stiffen the rotor rim against a second vibratory mode. Each of the first vibratory mode and the second vibratory modes have different frequencies. By adjusting, or altering, the depth of each triangular intrusions 262, the angles of the ribs 264, and the cross sectional area of the triangular intrusions 262, the stiffening of the rotor rim 220 is targeted toward specific vibrational frequencies, and bladed rotor assembly 100 is stiffened with minimal additional weight.

In some examples, the anti-vibration feature 260 is created in the rotor disk 102 either by creating a conventional bladed rotor assembly 100 (illustrated in FIG. 1) and milling the isogrid pattern into the radially outward facing surface. In alternative examples, the isogrid pattern can be cast in the rotor rim. In the alternative examples, the isogrid pattern can be further milled out to specific tolerances, when the tolerances on the isogrid pattern are tighter than the casting process can meet.

With continued reference to FIGS. 1, 2A, 2B, 3A, and 3B, FIGS. 4, 5 and 6 illustrate alternative geometric shaped intrusions 362, 462, 562 that can be utilized to create an isogrid anti-vibratory feature 360, 460, 560 for a bladed rotor assembly. As with the example anti-vibratory feature 260 of FIGS. 3A and 3B, the alternative geometric shaped intrusions 362, 462, 562 create ribs 364, 464, 564 that function similarly to the ribs 264 defined by the anti-vibratory feature 260 of FIGS. 3A and 3B. The ribs 364, 464, 564 in the alternative examples function in a similar manner.

The utilization of different shaped intrusions to form the isogrid pattern creates ribs 364, 464, 564 having varying strengths and varying abilities to tune vibratory modes. In the illustrated examples, the various geometric shaped intrusions protruding into the rotor rim 320, 420, 520 are uniform with a single shape intrusion being utilized to form all of the geometric shaped intrusions 362, 462, 562 in a single rotor rim 320, 420, 520. One of skill in the art, having the benefit of this disclosure, will understand that, in some examples, a combination of varied geometric shaped intrusions 362, 462, 562 can be utilized on a single rotor rim 320, 420, 520 to achieve a desired tuning effect.

While illustrated and described above with reference to a geared turbofan engine, one of skill in the art having the benefit of this disclosure will recognize that the described rotor disk assemblies including anti-vibratory features can be beneficially utilized in any gas powered turbine, including, but not limited to, direct drive gas turbine engines, land based turbines, and marine turbines.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A rotor disk comprising:

a ring shaped rotor body defining a radially inward opening;

rims protruding radially outward from said rotor body;

outwardly facing rotor blade retention slots defined between circumferentially adjacent rims, each slot being operable to receive and retain a corresponding rotor blade; and each rim of said rims includes an anti-vibratory feature, the anti-vibratory feature including a structure defining an isogrid pattern intruding into a surface of the rim, wherein the isogrid pattern comprises a plurality of geometric intrusions, the plurality of geometric intrusions including at least two distinct geometric shapes, and wherein said geometric intrusions are separated by, and define a plurality of stiffening ribs, and wherein each of said geometric intrusions defines a fully bounded geometric shape in at least one cross section.

2. The rotor disk of claim 1, wherein each of said geometric intrusions intrudes a uniform radial depth into said surface.

3. The rotor disk of claim 1, wherein said plurality of geometric intrusions comprises at least one of triangular intrusions, rectangular intrusions, and circular intrusions.

4. The rotor disk of claim 1, wherein said surface is a radially outward facing surface of said rim.

5. The rotor disk of claim 4, wherein said surface extends a full axial length of said rim.

6. A method for reducing vibrational bending in a bladed rotor disk, wherein the method comprises:

tuning a rotor rim for at least one vibrational mode using an anti-vibratory feature, wherein the anti-vibratory feature comprises an isogrid pattern intruding into a surface of the rotor rim the isogrid pattern including a plurality of geometric shaped intrusions into a radially outward facing surface, and a plurality of ribs defined by said geometric intrusions, wherein said geometric intrusions are a plurality of varied geometric shapes.

7. The method of claim 6, wherein tuning a rotor rim for at least one vibrational mode comprises providing localized vibrational tuning in distinct subsections of the rotor rim.

8. The method of claim 7, wherein at least one of a radial depth of the geometric intrusion and a cross sectional area of the geometric intrusion is varied across the isogrid pattern.

9. A rotor disk for utilization in a gas turbine engine comprising:

a ring shaped rotor body defining an axis;

rim features protruding radially outward from said ring shaped body;

outwardly facing rotor blade retention slots defined between circumferentially adjacent rims; and each rim of said rims includes an anti-vibratory feature, the anti-vibratory feature including a structure defining an isogrid pattern intruding into a surface of the rim the isogrid pattern including a plurality of geometric shaped intrusions into said radially outward facing surface, and a plurality of ribs defined by said geometric intrusions, wherein said geometric intrusions are a plurality of varied geometric shapes.

10. The rotor disk of claim 9, wherein said isogrid pattern is cast with said rim.

* * * * *